US011193475B2

(12) United States Patent
Chou et al.

(10) Patent No.: US 11,193,475 B2
(45) Date of Patent: Dec. 7, 2021

(54) CONNECTION STRUCTURE FOR MOTOR OF AIR COMPRESSOR

(71) Applicants: Wen-San Chou, Tainan (TW); Cheng-Hsien Chou, Tainan (TW)

(72) Inventors: Wen-San Chou, Tainan (TW); Cheng-Hsien Chou, Tainan (TW)

( * ) Notice: Subject to any disclaimer, the term of this patent is extended or adjusted under 35 U.S.C. 154(b) by 77 days.

(21) Appl. No.: 16/706,778

(22) Filed: Dec. 8, 2019

(65) Prior Publication Data

US 2020/0208620 A1 Jul. 2, 2020

(30) Foreign Application Priority Data

Dec. 14, 2018 (TW) ..... 107145367

(51) Int. Cl.

| | |
|---|---|
| ***F04B 35/00*** | (2006.01) |
| ***F04B 41/00*** | (2006.01) |
| ***F04B 35/04*** | (2006.01) |
| ***F04B 39/12*** | (2006.01) |
| ***F04B 53/16*** | (2006.01) |
| ***F04B 39/14*** | (2006.01) |
| ***F04B 53/22*** | (2006.01) |

(52) U.S. Cl.

CPC ..... *F04B 35/00* (2013.01); *F04B 35/04* (2013.01); *F04B 39/121* (2013.01); *F04B 39/14* (2013.01); *F04B 41/00* (2013.01); *F04B 53/16* (2013.01); *F04B 53/22* (2013.01)

(58) Field of Classification Search

CPC ..... F04B 35/00; F04B 41/00; F04B 39/121; F04B 53/16; F04B 35/04; F04B 39/14; F04B 53/22; F04B 53/144; F04B 53/006; F04B 39/0005; F04B 39/12; F04B 17/03; F05B 2260/30; F05B 2210/16; F05B 2210/12; F05B 2260/4031; F05B 2240/50; H02K 5/00–26; H02K 15/00–14; H02K 2207/00–03

See application file for complete search history.

(56) References Cited

U.S. PATENT DOCUMENTS

| | | | | |
|---|---|---|---|---|
| 5,620,311 | A * | 4/1997 | Wetzel | B60T 8/4022 417/415 |
| 8,629,583 | B2 * | 1/2014 | Bernhardt | H02K 9/14 310/50 |
| 2003/0107284 | A1 * | 6/2003 | Wickham | H02K 5/00 310/91 |
| 2005/0063840 | A1 * | 3/2005 | Chou | F04B 39/122 417/415 |

(Continued)

*Primary Examiner* — Bryan M Lettman

(57) ABSTRACT

A connection structure for a motor of an air compressor contains: a base, a cylinder, a motor, and a transmission mechanism. The base includes a first positioning orifice and a second positioning orifice. The cylinder includes an air storage seat. A small-diameter gear is inserted through the first positioning orifice to fit on the motor, a bearing housing is accommodated in the first positioning orifice, and the motor includes a magnetic coil. The transmission mechanism actuates a piston to move in the cylinder reciprocately so as to compress air. The magnetic coil includes a first segment and a second segment, and the base includes two symmetrical elongated plates which respectively have two hooks. The base further includes two symmetrical arcuate retainers.

7 Claims, 11 Drawing Sheets

(56) References Cited

U.S. PATENT DOCUMENTS

| | | | | |
|---|---|---|---|---|
| 2014/0158131 | A1* | 6/2014 | Kenyon | A61M 16/0858<br>128/204.18 |
| 2015/0330379 | A1* | 11/2015 | Chou | F16F 15/262<br>417/374 |
| 2018/0017056 | A1* | 1/2018 | Ohno | F04C 29/12 |
| 2018/0223824 | A1* | 8/2018 | Inoue | F04B 1/145 |

* cited by examiner

CONNECTION STRUCTURE FOR MOTOR OF AIR COMPRESSOR

FIELD OF THE INVENTION

The present invention relates to a connection structure for a motor of an air compressor which is capable of fixing the motor on the base without using any screw(s).

BACKGROUND OF THE INVENTION

Referring to FIGS. 8 and 9, a conventional air compressor 1 is mounted on a vehicle and contains a base 11, a cylinder 12 connected on the base 11, a motor 13 fixed on the base 11, and a piston 14 driven by the motor 13 to move in the cylinder 12 reciprocately so as to draw, compress, and discharge air.

The motor 13 is fixed on the base 11 by using multiple screws 15. However, the multiple screws 15 are removed easily after a period of using time.

As illustrated in FIGS. 10 and 11, when a length of the cylinder 12 is too long, the motor 13 cannot be fixed on the base 11. In other words, the motor 13 cannot be fixed on the base 11 by using the multiple screws 15.

The present invention has arisen to mitigate and/or obviate the afore-described disadvantages.

SUMMARY OF THE INVENTION

The primary aspect of the present invention is to provide a connection structure for a motor of an air compressor which is capable of fixing the motor on the base without using any screw(s).

In operation, the multiple through orifices of the front face are engaged on the multiple posts of the base individually, and the bearing housing of the front face of the motor is received in the first positioning orifice of the base, wherein an outer wall of the motor is retained by the two symmetrical arcuate retainers of the base. In the meantime, the first segment of the magnetic coil of the motor abuts against two top faces of the two symmetrical arcuate retainers, and the two hooks of the two symmetrical elongated plates of the base are engaged with the second segment of the magnetic coil so that the motor is fixed on the base securely.

DETAILED DESCRIPTION OF THE PREFERRED EMBODIMENTS

Figure 1:
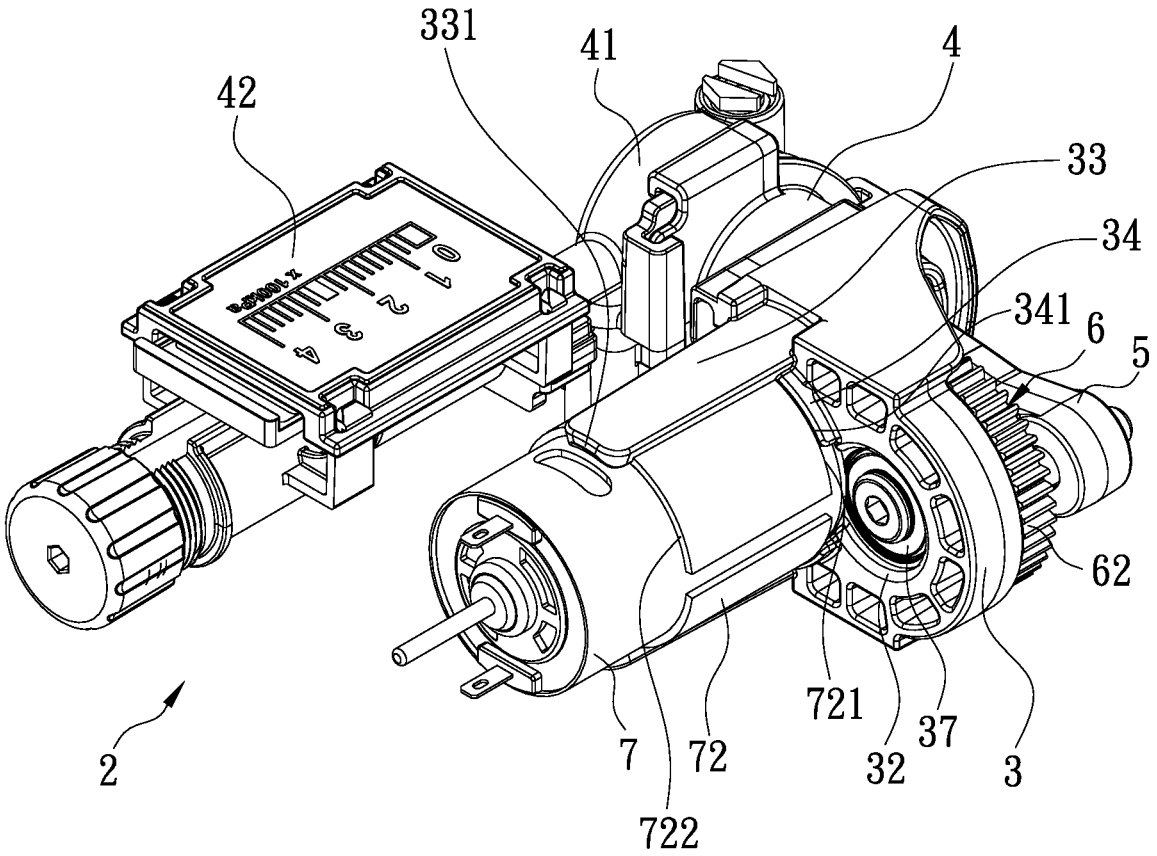
FIG. 1 is a perspective view showing the assembly of an air compressor according to a first embodiment of the present invention.
Figure 2:
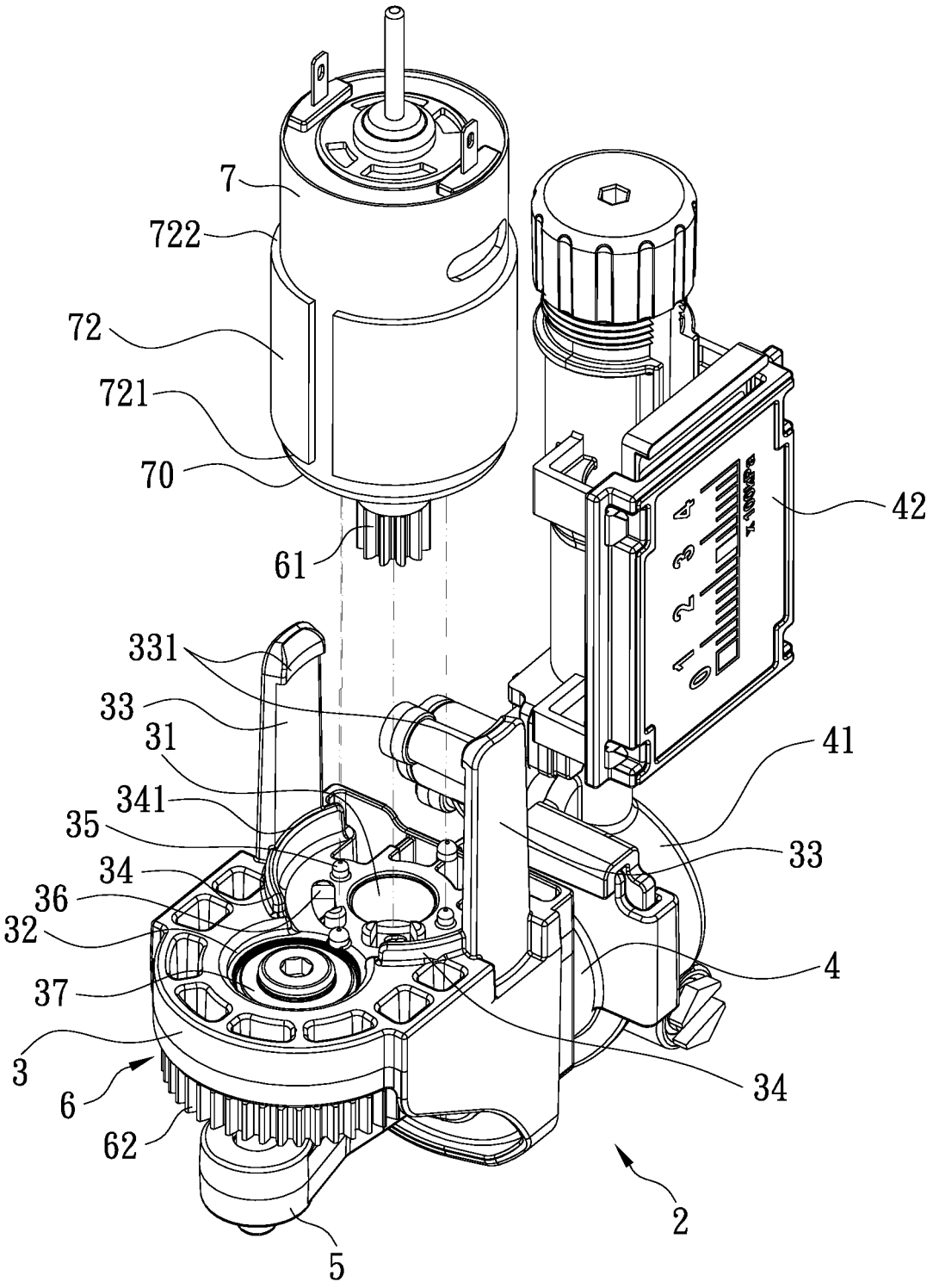
FIG. 2 is a perspective view showing the exploded components of the air compressor according to the first embodiment of the present invention.
Figure 3:
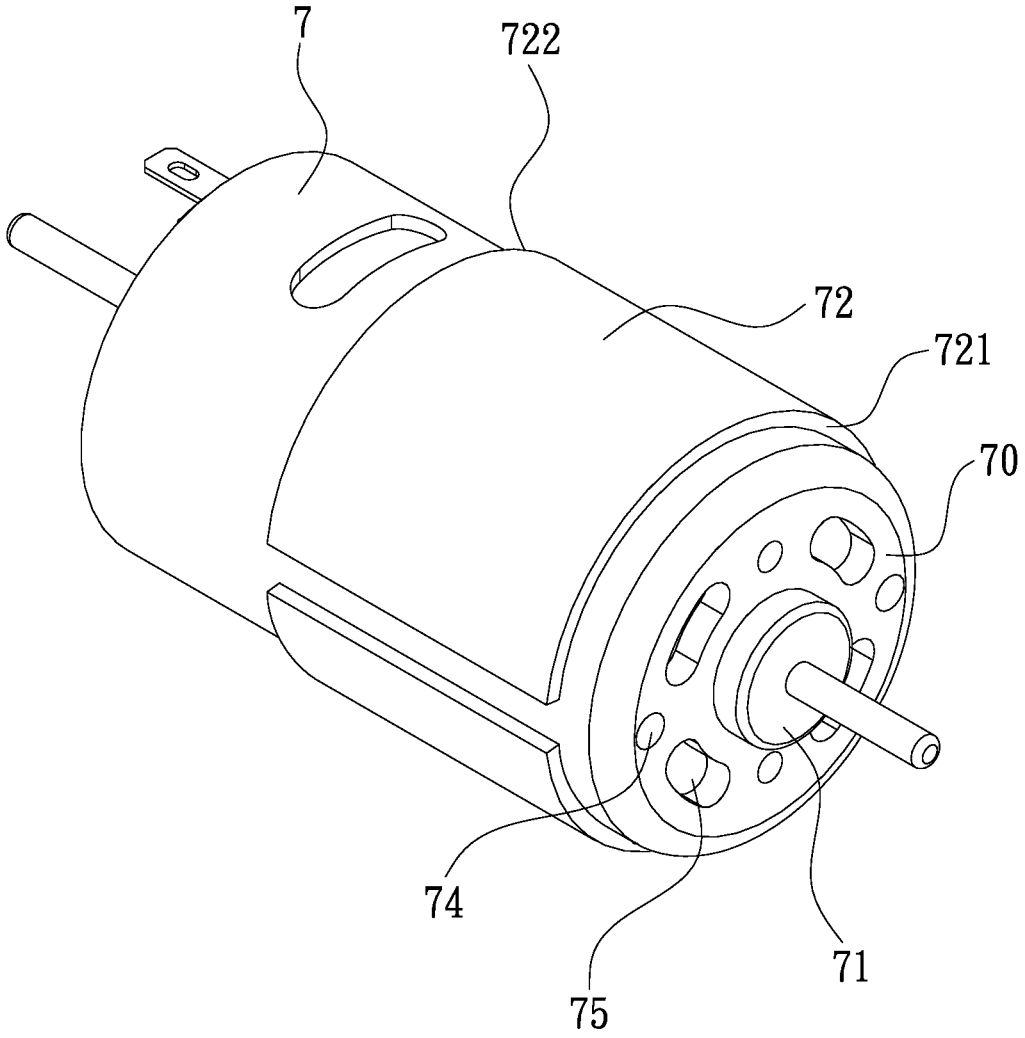
FIG. 3 is a perspective view showing the assembly of a part of the air compressor according to the first embodiment of the present invention.

With reference to FIGS. 1-3, a connection structure for a motor 7 of an air compressor 2 according to a first embodiment of the present invention, the air compressor 2 comprises: a base 3, a cylinder 4 connected on the base 3, the motor 7 fixed on the base 3, and a piston 5 driven by the motor 7 to move in the cylinder 4 reciprocately.

The base 3 includes multiple positioning orifices which are a first positioning orifice 31 and a second positioning orifice 32, wherein a small-diameter gear 61 is inserted through the first positioning orifice 31 to fit on a central shaft of the motor 7, and a bearing housing 71 of the motor 7 is accommodated in the first positioning orifice 31, a diameter A of a top of the small-diameter gear 61 is less than an outer diameter B of the bearing housing 71, and the second positioning orifice 32 accommodates a bearing 37. The motor 7 includes a magnetic coil 72 made of metal and configured to guide magnetism so as to enhance operating efficiency of the motor 7.

The cylinder 4 is one-piece or is movably connected on the base 3, and the cylinder 4 includes an air storage seat 41, an air pipe connected with the air storage seat 41 and configured to delivery air, and a pressure gauge 42 coupled on the air storage seat 41.

Figure 5:
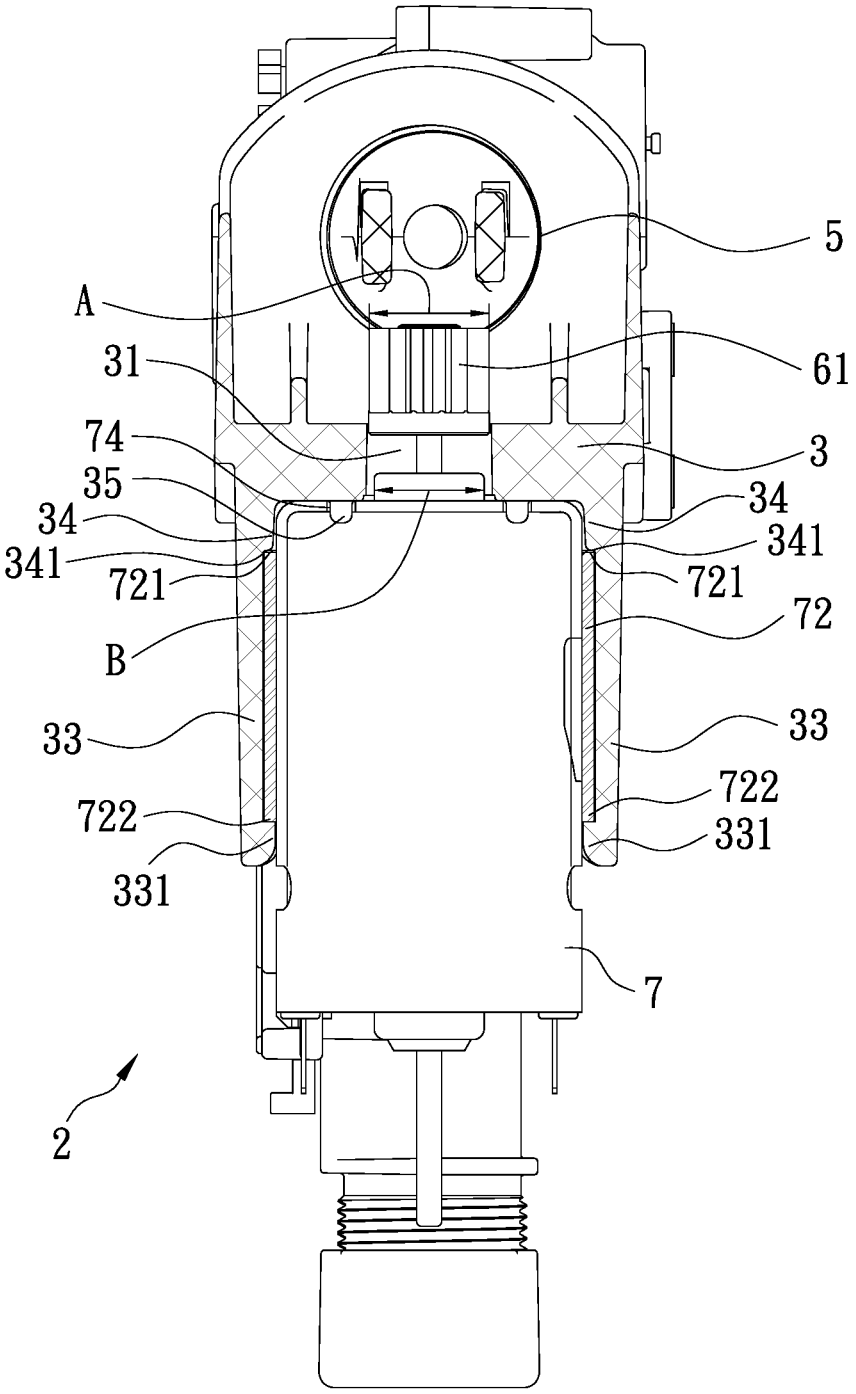
FIG. 5 is another cross sectional view showing the assembly of a part of the air compressor according to the first embodiment of the present invention.

The diameter A of the top of the small-diameter gear 61 is more than the outer diameter B of the bearing housing 71, as shown in FIG. 5.

A transmission mechanism 6 includes a large-diameter gear 62 having a counterweight block and meshing with the small-diameter gear 61, wherein the large-diameter gear 62 is connected with the bearing 37 via a connection rod (not shown), and the transmission mechanism 6 actuates the piston 5 to move in the cylinder 4 reciprocately so as to compress the air.

Figure 4:
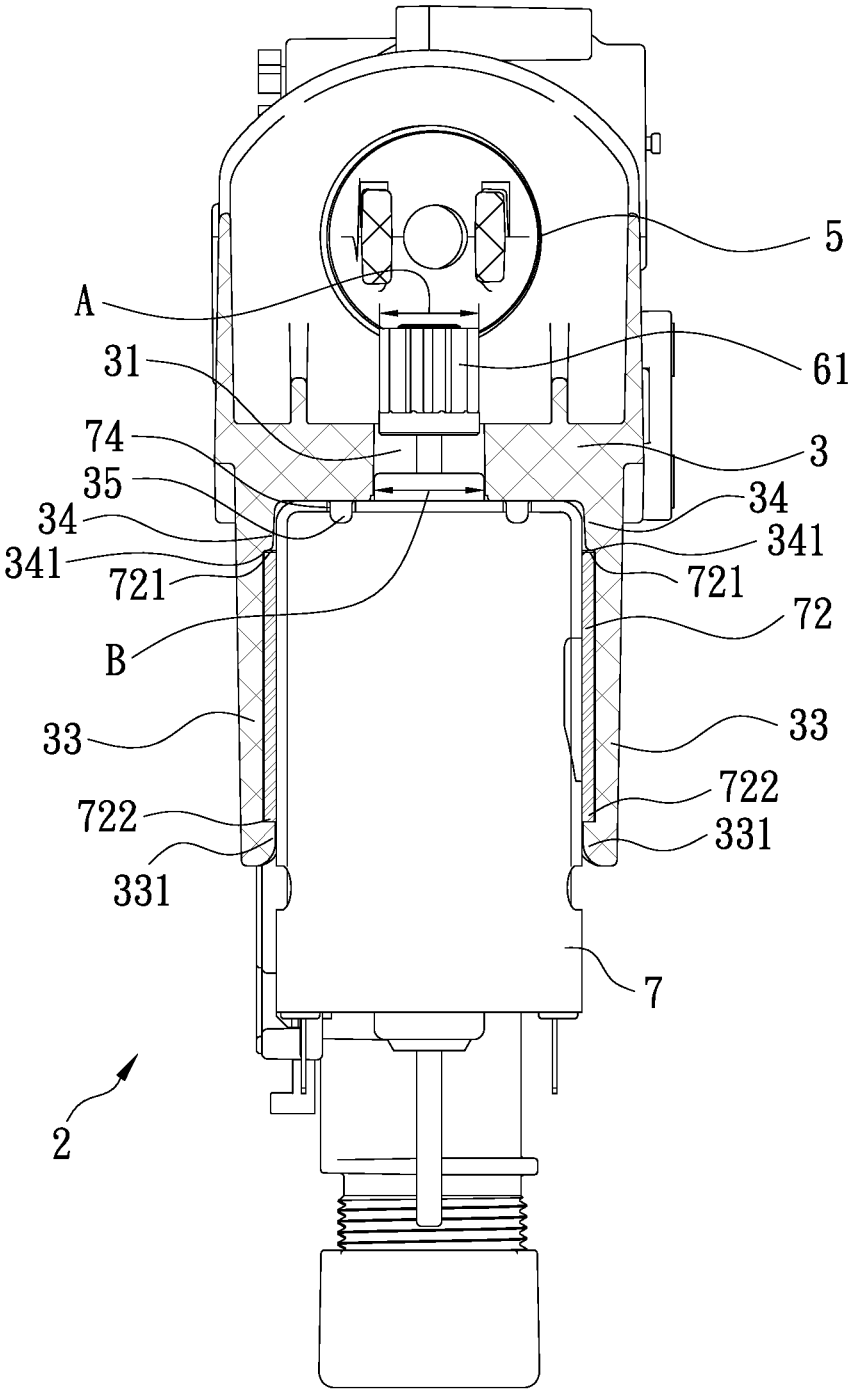
FIG. 4 is a cross sectional view showing the assembly of a part of the air compressor according to the first embodiment of the present invention.

Referring to FIGS. 2-4, the magnetic coil 72 of the motor 7 includes a first segment 721 and a second segment 722, and the motor 7 includes multiple through orifices 74, 75 defined around a front face 70 thereof, wherein the small-diameter gear 61 is fitted on the front face 70 of the motor 7. The base 3 includes two symmetrical elongated plates 33 extending from a rear end of the base 3, and the two symmetrical elongated plates 33 have two hooks 331 extending therefrom respectively. The base 3 further includes two symmetrical arcuate retainers 34 extending from two inner walls of the two symmetrical elongated plates 33 individually, multiple posts 35, 36 (as shown in FIG. 2) extending around the first positioning orifice 31 and corresponding to the multiple through orifices 74, 75 respectively. When desiring to fix the motor 7 on the base 3, the multiple through orifices 74, 75 of the front face 70 are engaged on the multiple posts 35, 36 of the base 3 individually, and the bearing housing 71 of the front face 70 of the motor 7 is received in the first positioning orifice 31 of the base 3, wherein an outer wall of the motor 7 is retained by the two symmetrical arcuate retainers 34 of the base 3. In the meantime, the first segment 721 of the magnetic coil 72 of the motor 7 abuts against two top faces 341 of the two symmetrical arcuate retainers 34, and the two hooks 331 of the two symmetrical elongated plates 33 of the base 3 are engaged with the second segment 722 of the magnetic coil 72 so that the motor 7 is fixed on the base 3 securely.

Figure 6:
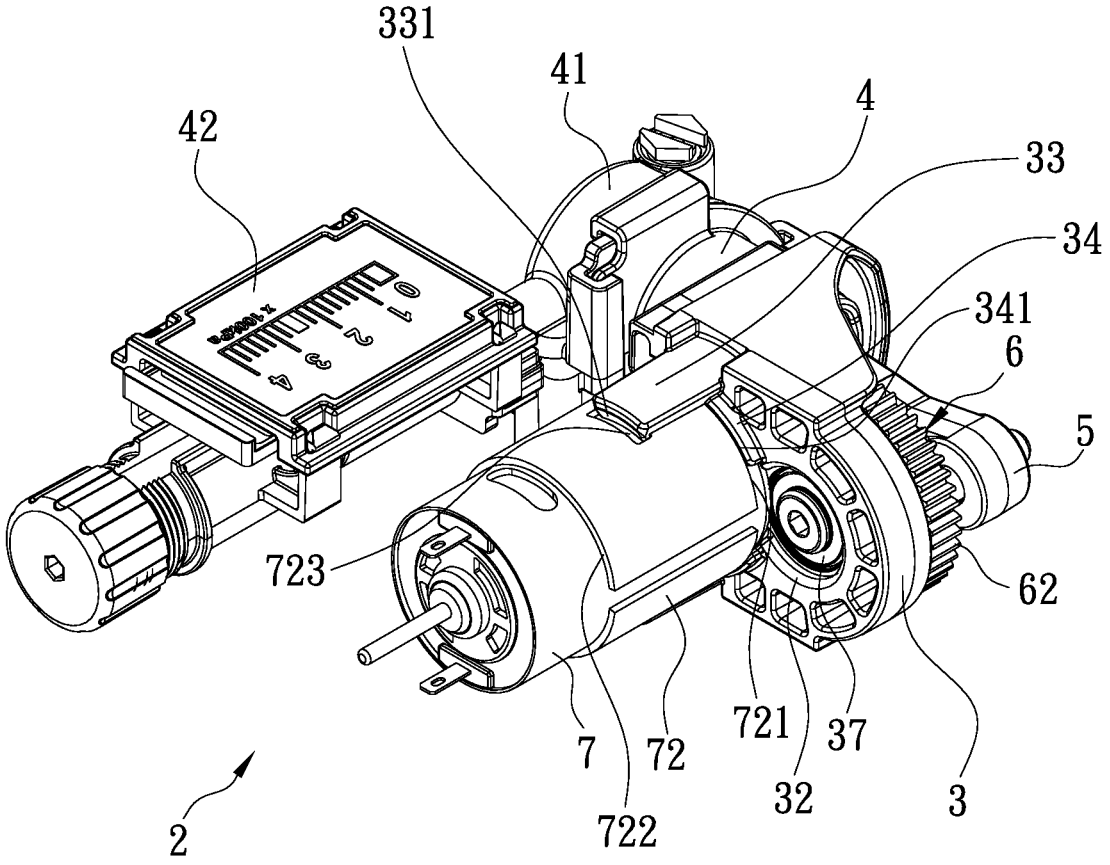
FIG. 6 is a perspective view showing the assembly of an air compressor according to a second embodiment of the present invention.
Figure 7:
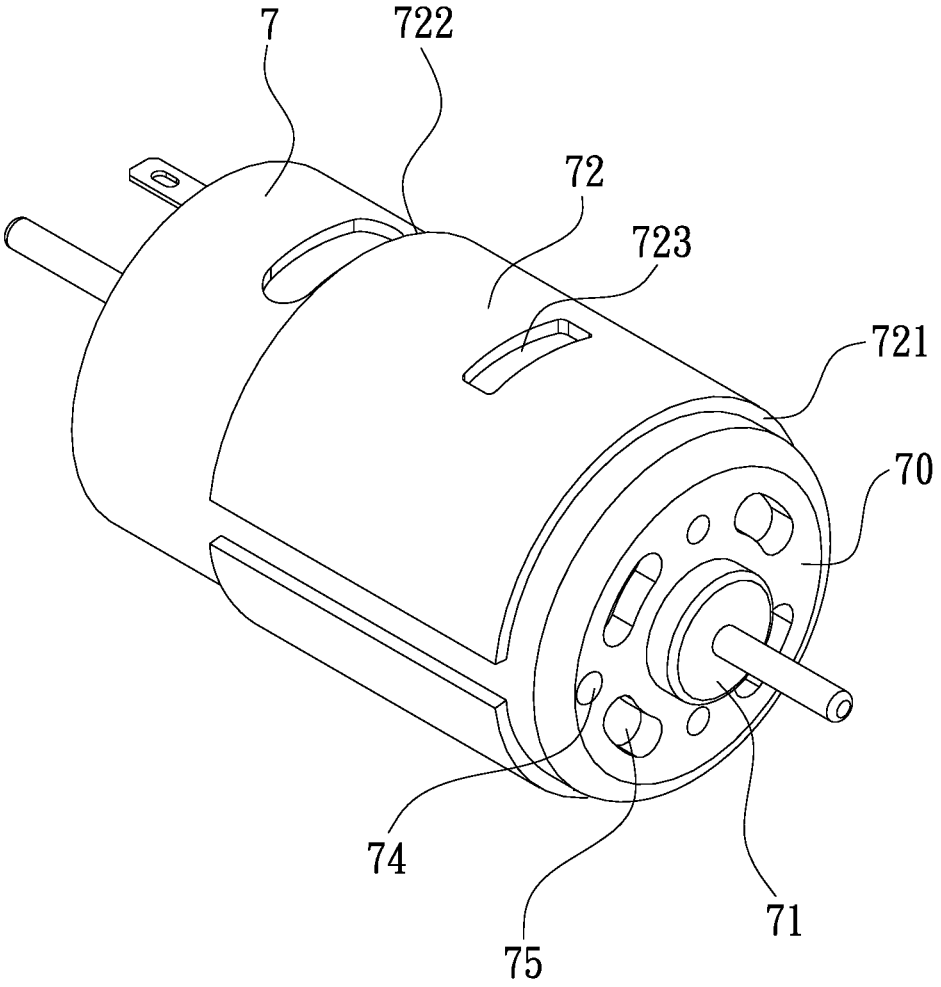
FIG. 7 is a perspective view showing the assembly of a part of the air compressor according to the second embodiment of the present invention.
Figure 8:
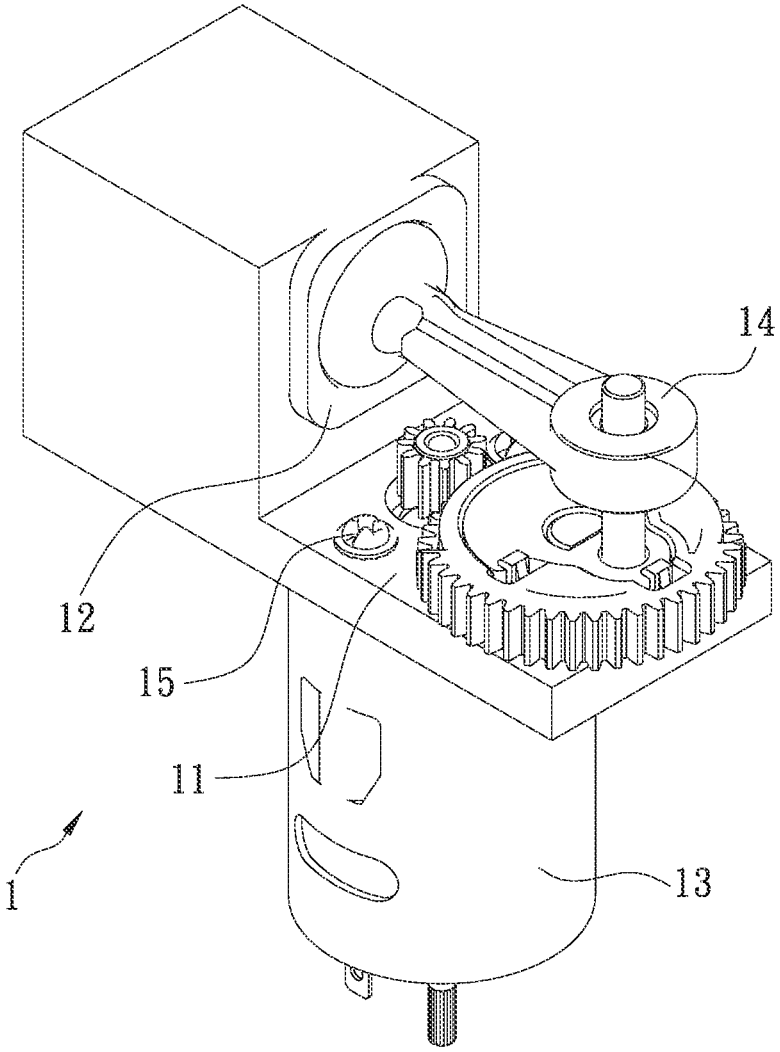
FIG. 8 Prior Art
FIG. 8 is a perspective view showing the assembly of a conventional air compressor.
Figure 9:
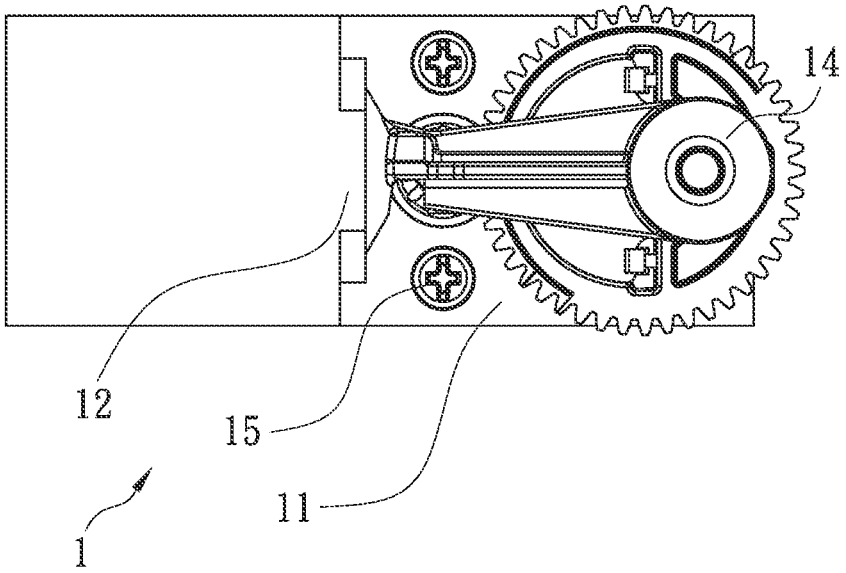
FIG. 9 Prior Art
FIG. 9 is a side plan view showing the assembly of the conventional air compressor.
Figure 10:
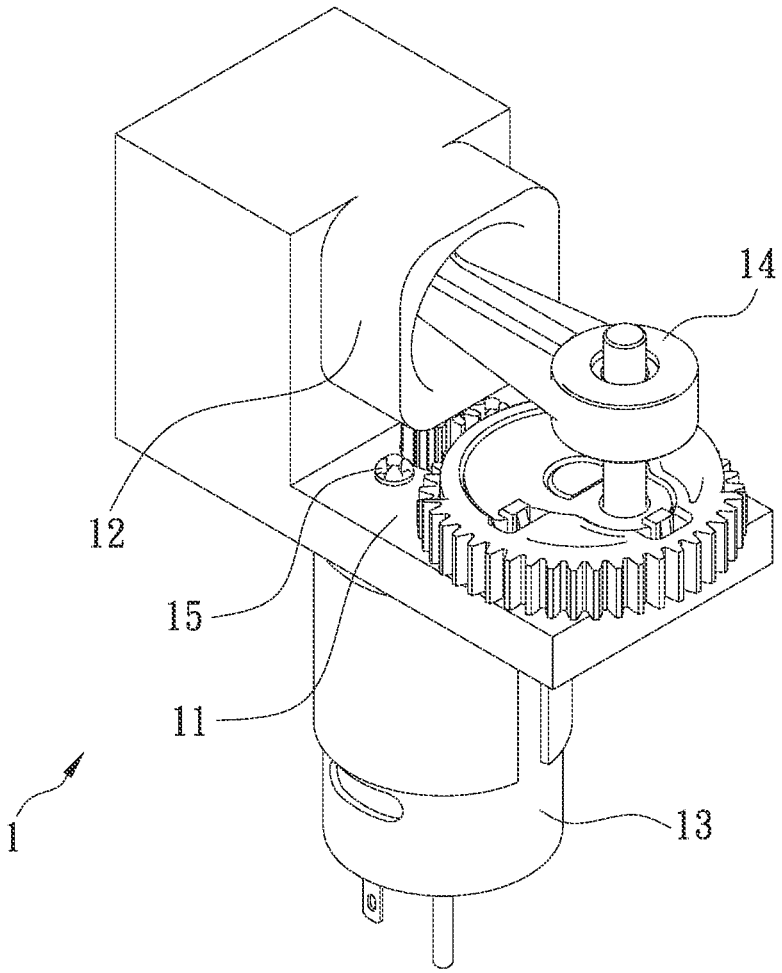
FIG. 10 Prior Art
FIG. 10 is another perspective view showing the assembly of the conventional air compressor.
Figure 11:
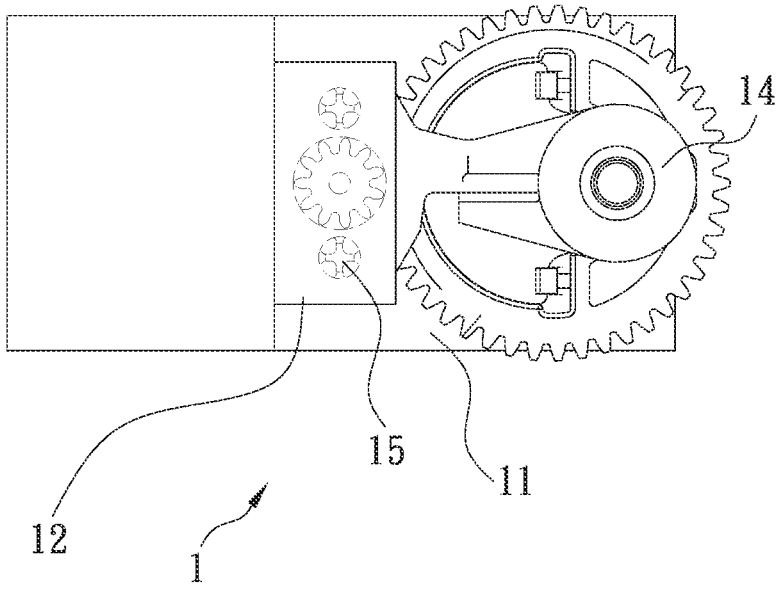
FIG. 11 Prior Art
FIG. 11 is another side plan view showing the assembly of the conventional air compressor.

In a second embodiment, as illustrated in FIGS. 6 and 7, two symmetrical fixing orifices 723 are defined between the first segment 721 and the second segment 722 of the magnetic coil 72 so that the two hooks 331 of the two symmetrical elongated plates 33 of the base 3 are engaged with the two symmetrical fixing orifices 723 of the magnetic coil 72 respectively, and the motor 7 is fixed on the base 3 securely.

Thereby, the multiple through orifices 74, 75 of the motor 7 are engaged on the multiple posts 35, 36 of the base 3 individually, and the bearing housing 71 of the front face 70 of the motor 7 is received in the first positioning orifice 31 of the base 3, wherein the outer wall of the motor 7 is retained by the two symmetrical arcuate retainers 34 of the base 3. In the meantime, the first segment 721 of the magnetic coil 72 of the motor 7 abuts against two top faces 341 of the two symmetrical arcuate retainers 34, and the two hooks 331 of the two symmetrical elongated plates 33 of the base 3 are engaged with the magnetic coil 72 so that the motor 7 is fixed on the base 3 securely.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A connection structure for an air compressor comprising:

a base comprising a first positioning orifice and a second positioning orifice;

a cylinder connected on the base and including an air storage seat;

a motor fixed on the base, a small-diameter gear fit on a central shaft of the motor, a bearing housing of the motor being accommodated in the first positioning orifice, and the motor including a magnetic member made of metal defining a first segment ridge on an external surface of the motor; and a transmission mechanism actuating a piston to move in the cylinder reciprocatingly so as to compress air;

wherein the base comprises two elongated plates extending from a rear end of the base, and the two elongated plates each having a respective hook extending therefrom, the base further comprising two arcuate retainers, each extending radially inward from an inner wall of a respective elongated plate and comprising a top face;

the first segment ridge of the magnetic member of the motor abuts against the two top faces of the two arcuate retainers, and the two hooks of the two elongated plates of the base are engaged with the magnetic member so that the motor is fixed on the base.

2. The connection structure as claimed in claim 1, wherein the magnetic member defines a second segment ridge, and the two hooks of the two elongated plates of the base are engaged with the second segment ridge of the magnetic member so that the motor is fixed on the base.

3. The connection structure as claimed in claim 1, wherein a diameter of a top of the small-diameter gear is less than an outer diameter of the bearing housing, and the second positioning orifice accommodates a bearing.

4. The connection structure as claimed in claim 3, wherein the transmission mechanism includes a large-diameter gear meshing with the small-diameter gear, wherein the large-diameter gear is connected with the bearing via a connection rod.

5. The connection structure as claimed in claim 4, wherein the motor includes multiple through orifices defined around a front face thereof, and the base further includes multiple posts extending around the first positioning orifice and respectively corresponding to the multiple through orifices.

6. The connection structure as claimed in claim 1, wherein a diameter of a top of the small-diameter gear is more than an outer diameter of the bearing housing.

7. The connection structure as claimed in claim 1, wherein two fixing orifices are defined in the magnetic member so that the two hooks of the two elongated plates of the base are respectively engaged with the two fixing orifices of the magnetic member, and the motor is fixed on the base.

* * * * *